US011613921B2

(12) United States Patent
Nau et al.

(10) Patent No.: US 11,613,921 B2
(45) Date of Patent: Mar. 28, 2023

(54) SPRING-LOADED SASH GUIDE

(71) Applicant: PGT Innovations, Inc., North Venice, FL (US)

(72) Inventors: Michael Dietmar Nau, North Port, FL (US); Hong Chen, Sarasota, FL (US); Kenneth T. Patek, Venice, FL (US)

(73) Assignee: PGT Innovations, Inc., North Venice, FL (US)

( * ) Notice: Subject to any disclaimer, the term of this patent is extended or adjusted under 35 U.S.C. 154(b) by 2 days.

(21) Appl. No.: 17/154,780

(22) Filed: Jan. 21, 2021

(65) Prior Publication Data

US 2021/0140214 A1 May 13, 2021

Related U.S. Application Data

(62) Division of application No. 16/036,277, filed on Jul. 16, 2018, now Pat. No. 10,927,579.

(60) Provisional application No. 62/614,696, filed on Jan. 8, 2018.

(51) Int. Cl.

| | |
|---|---|
| ***E05F 1/00*** | (2006.01) |
| ***E05D 15/16*** | (2006.01) |
| ***E06B 7/22*** | (2006.01) |
| ***E06B 3/44*** | (2006.01) |

(52) U.S. Cl.

CPC ..... *E05D 15/165* (2013.01); *E06B 3/44* (2013.01); *E06B 7/22* (2013.01); *E05Y 2900/148* (2013.01)

(58) Field of Classification Search

CPC ..... E05D 15/165; E06B 3/44; E06B 3/4407; E06B 7/22; E05Y 2900/148; E05Y 2800/344

See application file for complete search history.

(56) References Cited

U.S. PATENT DOCUMENTS

| | | | | |
|---|---|---|---|---|
| 1,427,088 | A | 8/1922 | Bowler | |
| 1,436,086 | A | 11/1922 | Bobrowski | |
| 3,080,622 | A | 3/1963 | Mendelsohn | |
| 3,364,622 | A | 1/1968 | Collard | |
| 3,404,499 | A | 10/1968 | Lewis | |
| 3,592,493 | A | 7/1971 | Goose | |
| 3,676,956 | A | 7/1972 | Taylor et al. | |
| 3,866,380 | A | 2/1975 | Benson | |
| 4,028,849 | A | 6/1977 | Anderson | |
| 4,400,026 | A | 8/1983 | Brown, Jr. | |
| 4,453,855 | A | 6/1984 | Richter et al. | |
| 4,622,778 | A * | 11/1986 | Simpson | E05D 15/22 49/180 |
| 4,941,287 | A | 7/1990 | Guelck | |

(Continued)

FOREIGN PATENT DOCUMENTS

| | | |
|---|---|---|
| EP | 0049204 | 12/1985 |

OTHER PUBLICATIONS

Nau, Michael Dietmar; Non-Final Office Action for U.S. Appl. No. 16/036,277, filed Jul. 16, 2018, dated Jul. 16, 2020, 14 pgs.

(Continued)

*Primary Examiner* — Jerry E Redman

(74) *Attorney, Agent, or Firm* — Taylor English Duma LLP

(57) ABSTRACT

A sash includes a stile, the stile defining a first flange and a second flange, a locking slot defined extending through the first flange; and a sash guide, the sash guide defining a first guide leg and a second guide leg, the first guide leg defining a locking tab, the locking tab extending through the locking slot.

11 Claims, 9 Drawing Sheets

(56) References Cited

U.S. PATENT DOCUMENTS

| | | | | |
|---|---|---|---|---|
| 4,970,840 | A | 11/1990 | Ouellette et al. | |
| 5,274,955 | A | 1/1994 | Dallaire et al. | |
| 5,301,989 | A | 4/1994 | Dallmann et al. | |
| 6,122,864 | A * | 9/2000 | Martin | E06B 7/23 49/428 |
| 6,305,126 | B1 | 10/2001 | Hendrickson et al. | |
| 6,364,589 | B1 | 4/2002 | Wenglinski | |
| 6,694,683 | B2 | 2/2004 | Anderson et al. | |
| 6,948,278 | B1 * | 9/2005 | Schultz | E05B 65/0876 292/DIG. 47 |
| 7,448,164 | B1 | 11/2008 | McCabe | |
| 7,694,470 | B2 | 4/2010 | Schultz et al. | |
| 8,266,851 | B2 | 9/2012 | Campbell et al. | |
| 8,424,245 | B1 * | 4/2013 | Kunz | E05D 15/22 49/185 |
| 8,550,507 | B2 * | 10/2013 | Barton | E05C 3/12 292/228 |
| 8,978,303 | B1 | 3/2015 | Rogers et al. | |
| 9,611,688 | B1 * | 4/2017 | Vanderbent, Jr. | E06B 3/9641 |
| 9,670,691 | B2 | 6/2017 | Mansueto et al. | |
| 10,167,658 | B2 | 1/2019 | Denormand | |
| 10,927,579 | B2 * | 2/2021 | Nau | E05D 15/165 |
| 2005/0086880 | A1 | 4/2005 | Polowinczak | |
| 2007/0056217 | A1 * | 3/2007 | Silverman | E05D 15/22 49/176 |
| 2007/0137109 | A1 * | 6/2007 | Tremble | E05B 9/08 49/185 |
| 2008/0129054 | A1 | 6/2008 | Tremble et al. | |
| 2019/0211601 | A1 | 7/2019 | Nau et al. | |

OTHER PUBLICATIONS

Nau, Michael Dietmar; Notice of Allowance for U.S. Appl. No. 16/036,277, filed Jul. 16, 2018, dated Oct. 23, 2020, 5 pgs.

Nau, Michael Dietmar; Requirement for Restriction/Election for U.S. Appl. No. 16/036,277, filed Jul. 16, 2018, dated Apr. 7, 2020, 7 pgs.

Yocumglass; Brochure entitled: "Your One Stop Source for All Your Window & Door Hardware", located at <http://www.yocumglass.com/pdfs/Sash%20Support%20Systems.pdf>, publicly available prior to Jul. 16, 2018, 107 pgs.

* cited by examiner

SPRING-LOADED SASH GUIDE

CROSS-REFERENCE TO RELATED APPLICATIONS

This application is a divisional of U.S. application Ser. No. 16/036,277, filed Jul. 16, 2018, now U.S. Pat. No. 10,927,579, which issued on Feb. 23, 2021, which claims the benefit of U.S. Provisional Application No. 62/614,696, filed on Jan. 8, 2018, which are each hereby incorporated by reference in their entireties.

TECHNICAL FIELD

This disclosure relates to window frame assemblies. More specifically, this disclosure relates to a sash guide for a sash of a window frame assembly.

BACKGROUND

Hung windows commonly comprise a sash and a window frame. The sash can ride between a pair of balance jambs of the window frame. The sash can comprise sash guides, which can guide the sash over balances in the balance jambs. Dimensional variations of the balance jambs can cause the sash to bind between the balance jambs. The sash can be fit with undersized sash guides to prevent binding; however, the sash may not seal properly with the window frame due to the undersized sash guides.

SUMMARY

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

Disclosed is a sash comprising a stile, the stile defining a first flange and a second flange, a locking slot defined extending through the first flange; and a sash guide, the sash guide defining a first guide leg and a second guide leg, the first guide leg defining a locking tab, the locking tab extending through the locking slot.

Also disclosed is a sash guide comprising a guide cap, the guide gap defining a bottom guide cap surface; a first leg extending downwards from the bottom guide cap surface; and a second leg extending downwards from the bottom guide cap surface.

Also disclosed is a method for assembling a window frame assembly, the method comprising inserting a first leg of a sash guide into a stile channel, the stile channel defined by a stile of a sash, the window frame assembly comprising the sash; and engaging a locking tab defined by the first leg with a locking slot defined by the stile.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims. The features and advantages of such implementations may be realized and obtained by means of the systems, methods, features particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

The features and components of the following figures are illustrated to emphasize the general principles of the present disclosure. The drawings are not necessarily drawn to scale. Corresponding features and components throughout the figures may be designated by matching reference characters for the sake of consistency and clarity.

DETAILED DESCRIPTION

Figure 1:
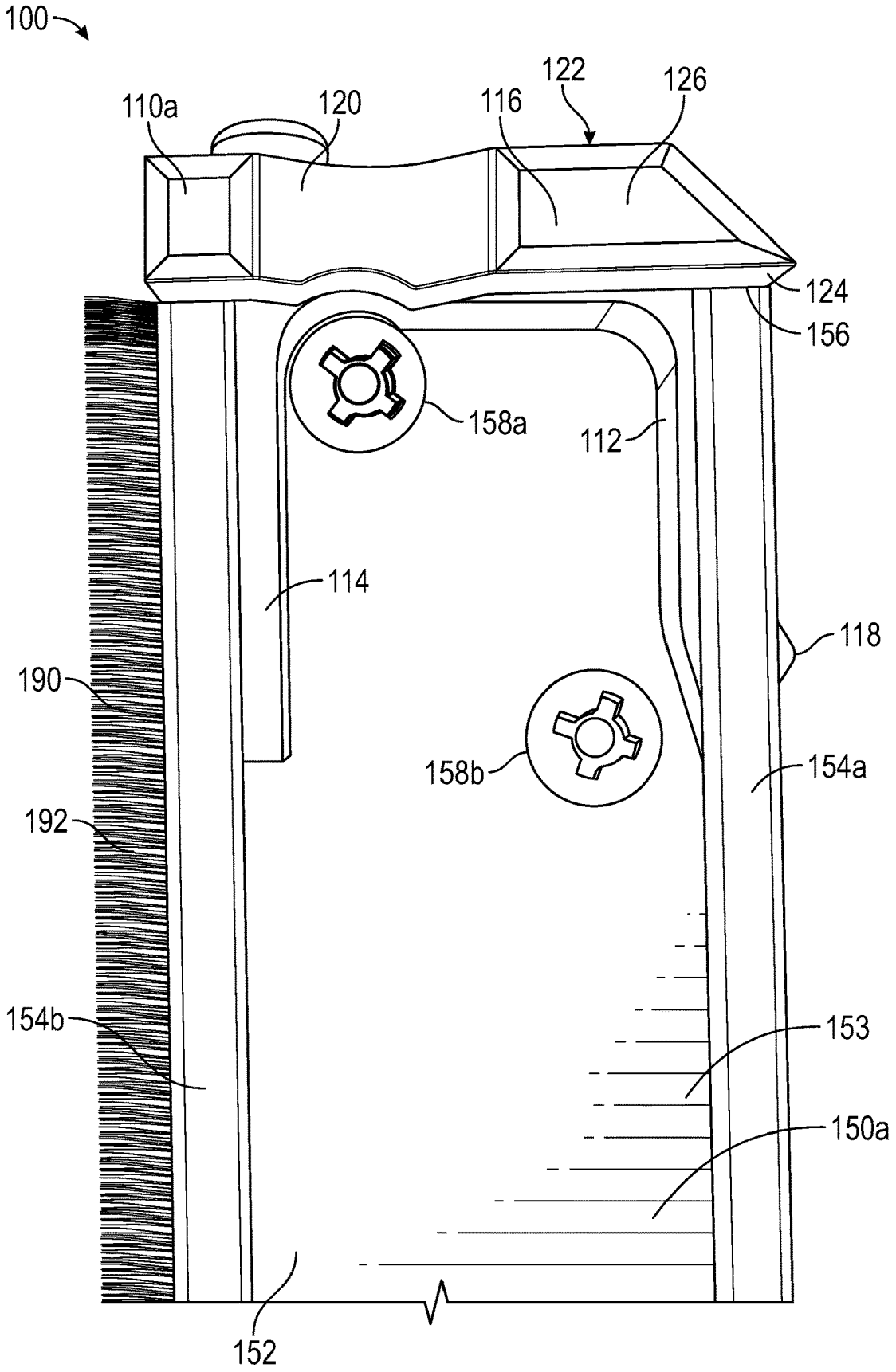
FIG. 1 is a side view of a sash comprising a first sash guide, a first stile, and a first weather strip in accordance with one aspect of the present disclosure.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can include two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

Disclosed is a sash guide and associated methods, systems, devices, and various apparatus. The sash guide can comprise a guide cap, a first guide leg, and a second guide leg. It would be understood by one of skill in the art that the disclosed sash guide is described in but a few exemplary aspects among many. No particular terminology or description should be considered limiting on the disclosure or the scope of any claims issuing therefrom.

FIG. 1 is a side view of a sash 100 comprising a first sash guide 110*a*, a first stile 150*a*, and a weather strip 190 in accordance with one aspect of the present disclosure. The first stile 150*a* can define a first flange 154*a* and a second flange 154*b* connected by a web 152. The first flange 154*a*, the second flange 154*b*, and the web 152 can define a stile channel 153 extending along a length of the first stile 150*a*. The weather strip 190 can be attached to the second flange 154*b* opposite from the first flange 154*a*, and the weather strip 190 can comprise a plurality of bristles 192 extending outwards and away from the first stile 150*a*. A pair of fasteners 158*a,b* can attach the first stile 150*a* to a top rail 370 (shown in FIG. 3) of the sash 100.

The first sash guide 110*a* can be attached to a top end 156 of the first stile 150*a*. The first sash guide 110*a* can define a guide cap 116, a first guide leg 112, and a second guide leg 114. The guide cap 116 can define an outer surface 126 positioned opposite from the top rail 370 (shown in FIG. 3), and the outer surface 126 can define a concave balance groove 120 extending into the guide cap 116. The guide cap 116 can also define a top guide cap surface 122 and a bottom guide cap surface 124 disposed opposite from the top guide cap surface 122. The bottom guide cap surface 124 can be positioned in facing engagement with the top end 156 of the first stile 150*a*, and the guide legs 112,114 can each extend downwards from the guide cap 116 substantially perpendicular to the bottom guide cap surface 124.

The guide legs 112,114 can be inserted into the stile channel 153 with the first guide leg 112 engaging the first flange 154*a* and the second guide leg 114 engaging the second flange 154*b* of the first stile 150*a*. The first sash guide 110*a* can comprise a resilient material, and the guide legs 112,114 can elastically deflect subtly towards one another to snap into the stile channel 153 to secure the first sash guide 110*a* to the first stile 150*a*. Additionally, the first guide leg 112 can define a locking tab 118, which can extend through first flange 154*a* of the first stile 150*a* to secure the first sash guide 110*a* to the first stile 150*a*.

Figure 2:
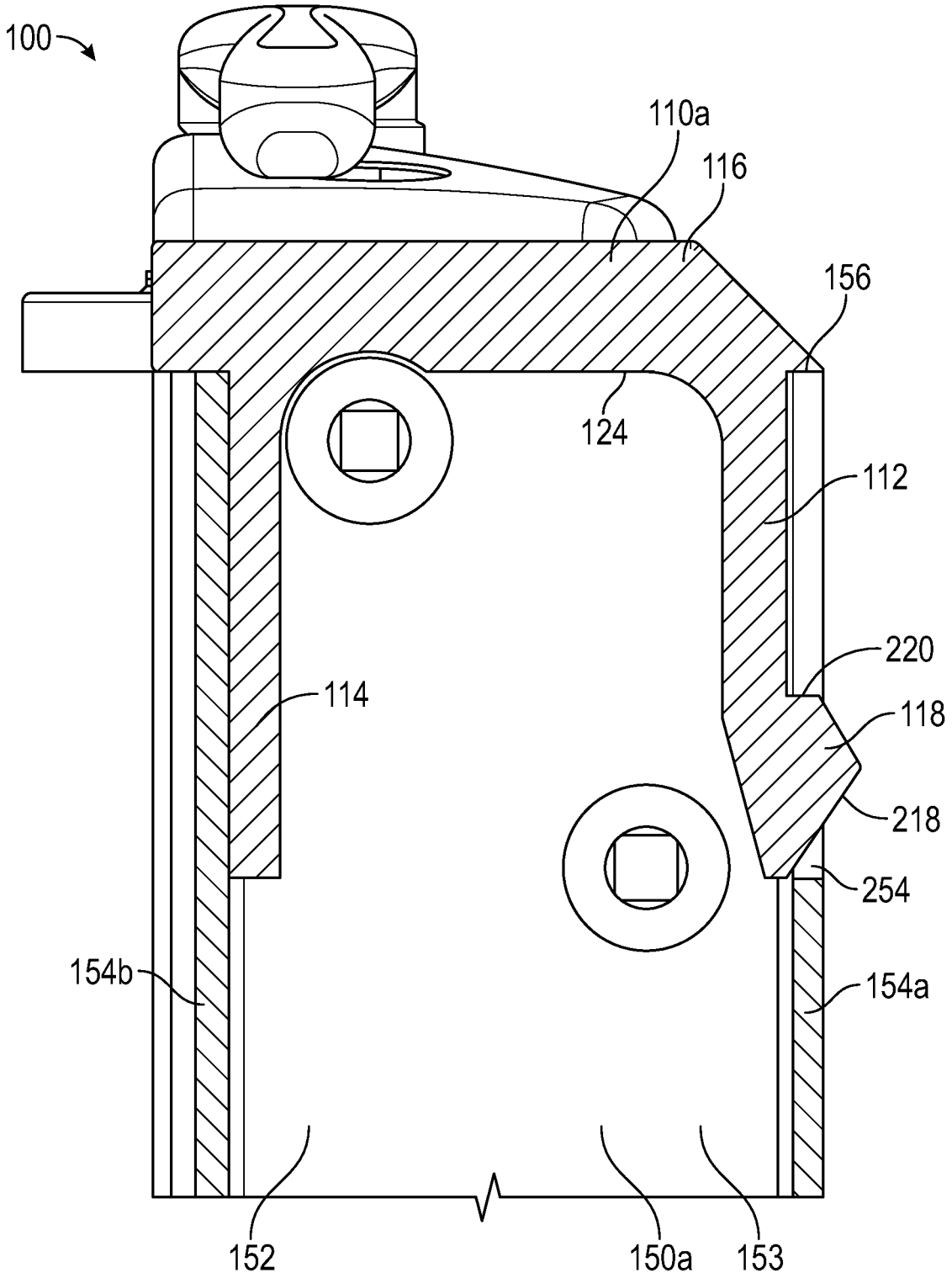
FIG. 2 is a side cross-sectional view of the sash of FIG. 1.

FIG. 2 is a side cross-sectional view of the sash 100 of FIG. 1. In the present aspect, the first flange 154*a* can define a locking slot 254, and the locking tab 118 can extend through the locking slot 254 to secure the first sash guide 110*a* to the top end 156 of the first stile 150*a* and to prevent withdrawal of the guide legs 112,114 from the stile channel 153. The locking tab 118 can define a sloped leading edge 218 configured to ease insertion of the guide legs 112,114 into the stile channel 153 from the top end 156. The locking tab 118 can additionally define a locking shoulder 220 disposed opposite from the sloped leading edge 218. The locking shoulder 220 can be defined substantially square to the first guide leg 112, and the locking shoulder 220 can be shaped to interfere with the locking slot 254 to resist withdrawal of the guide legs 112,114 from the stile channel 153. The first sash guide 110*a* can be withdrawn from the stile channel 153 by pressing the locking tab 118 back through the locking slot 254 and withdrawing the guide legs 112,114 from the stile channel 153.

Figure 3:
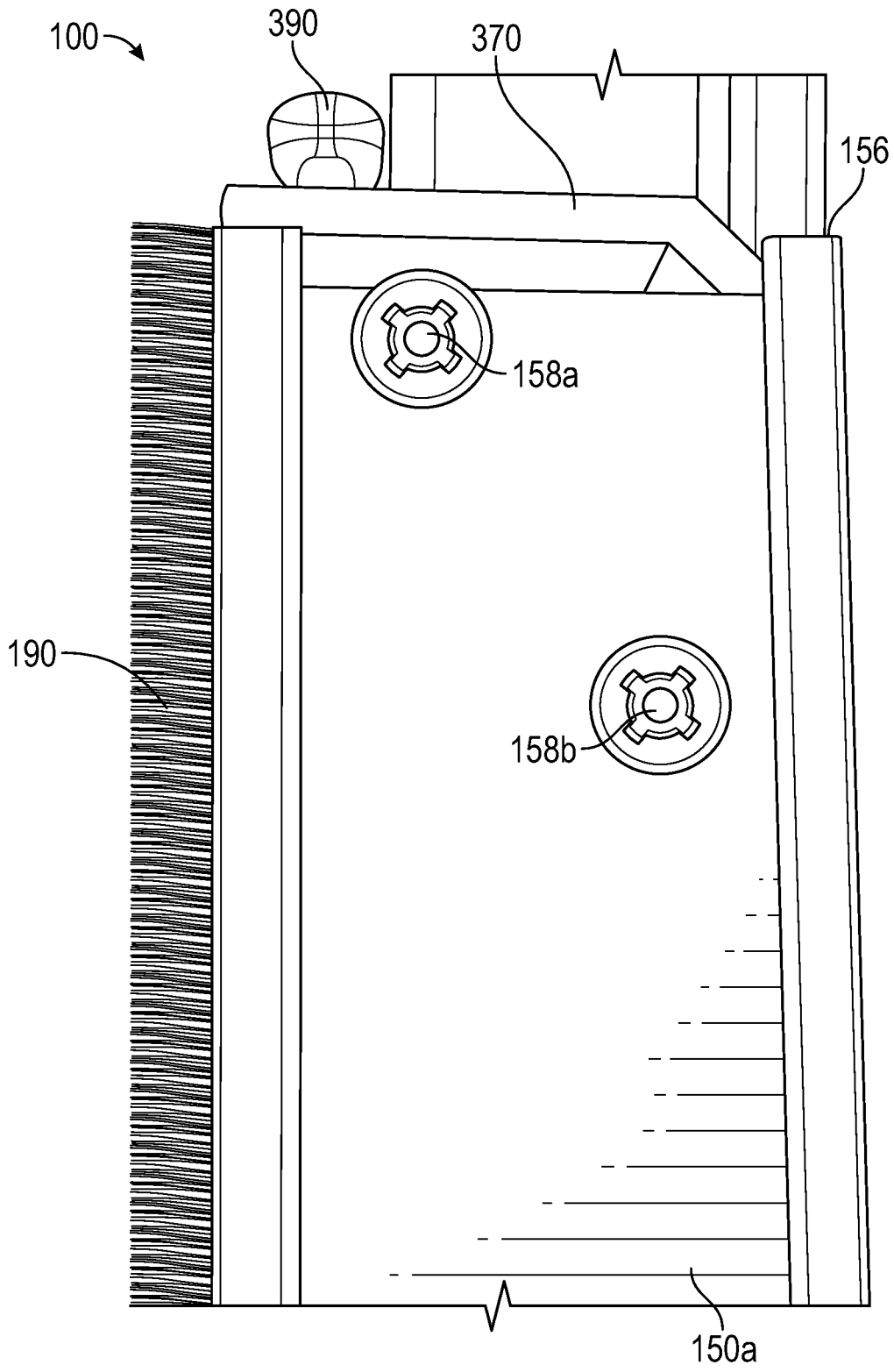
FIG. 3 is a side view of the sash of FIG. 1 with the first sash guide removed.

FIG. 3 is a side view of the sash 100 of FIG. 1 with the first sash guide 110*a* (shown in FIG. 1) removed. As shown, the first stile 150*a* can be attached at the top end 156 to the top rail 370 by the fasteners 158*a,b*. In the present aspect, the first stile 150*a* can be attached to the top rail 370 prior to installation of the first sash guide 110*a* which can facilitate assembly of the sash 100. In the present aspect, the sash 100 can further comprise a locking mechanism 390, which can be mounted to the top rail 370.

Figure 4:
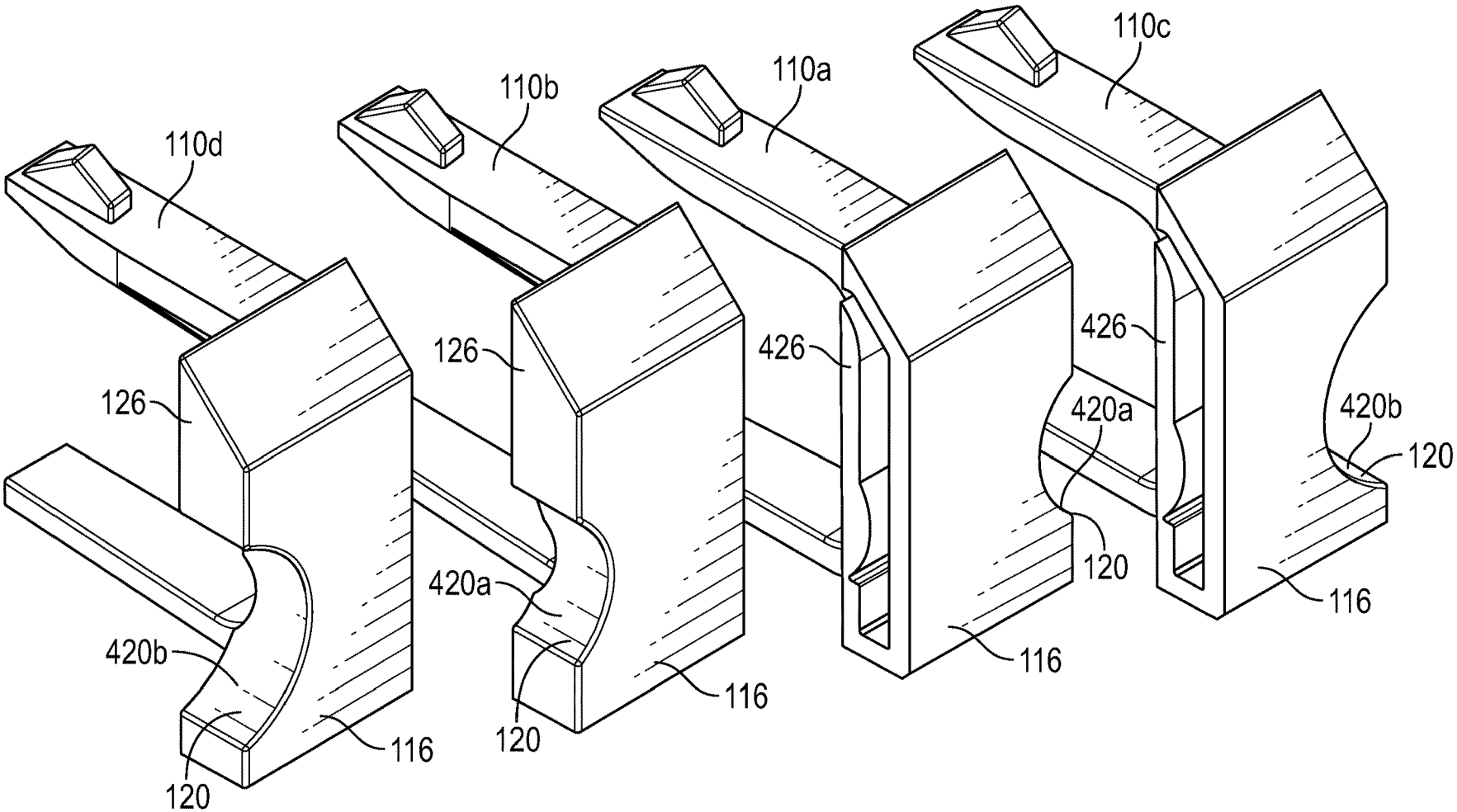
FIG. 4 is a perspective view of a plurality of sash guides in accordance with various aspects of the present disclosure, including the first sash guide of FIG. 1.

FIG. 4 is a perspective view of a plurality of sash guides 110*a-d* in accordance with various aspects of the present disclosure, including the first sash guide 110*a* of FIG. 1. The sash guides 110*b,d* can be right-handed sash guides, and the sash guides 110*a,c*, can be left-handed sash guides. The sash guide 110*b* can be a second sash guide 110*b* of the sash 100 as shown in FIG. 7 below.

Each of the sash guides 110*a-d* can respectively define the concave balance grooves 120. For the sash guides 110*a,b*, the concave balance grooves 120 can be small balance grooves 420*a*. For the sash guides 110*c,d*, the concave balance grooves 120 can be large balance grooves 420*b* which can define concave balance grooves 120 sized larger than the small balance grooves 420*a*. The sash guides 110*a,c* can show an inner side 426 of the guide cap 116 defined opposite from the outer surface 126 of each respective guide cap 116 (outer surfaces 126 not shown for sash guides 110*a,c*). The inner side 426 can be configured to be positioned adjacent to the top rail 370 (shown in FIG. 3) while the outer surfaces 126 can be configured to face away from the top rail 370 once installed on the sash 100 (shown in FIG. 1). In the present aspect, the guide caps 116 can be hollow moldings as shown by sash guides 110*a,c*. In other aspects, the guide caps 116 can be solid.

Figure 5:
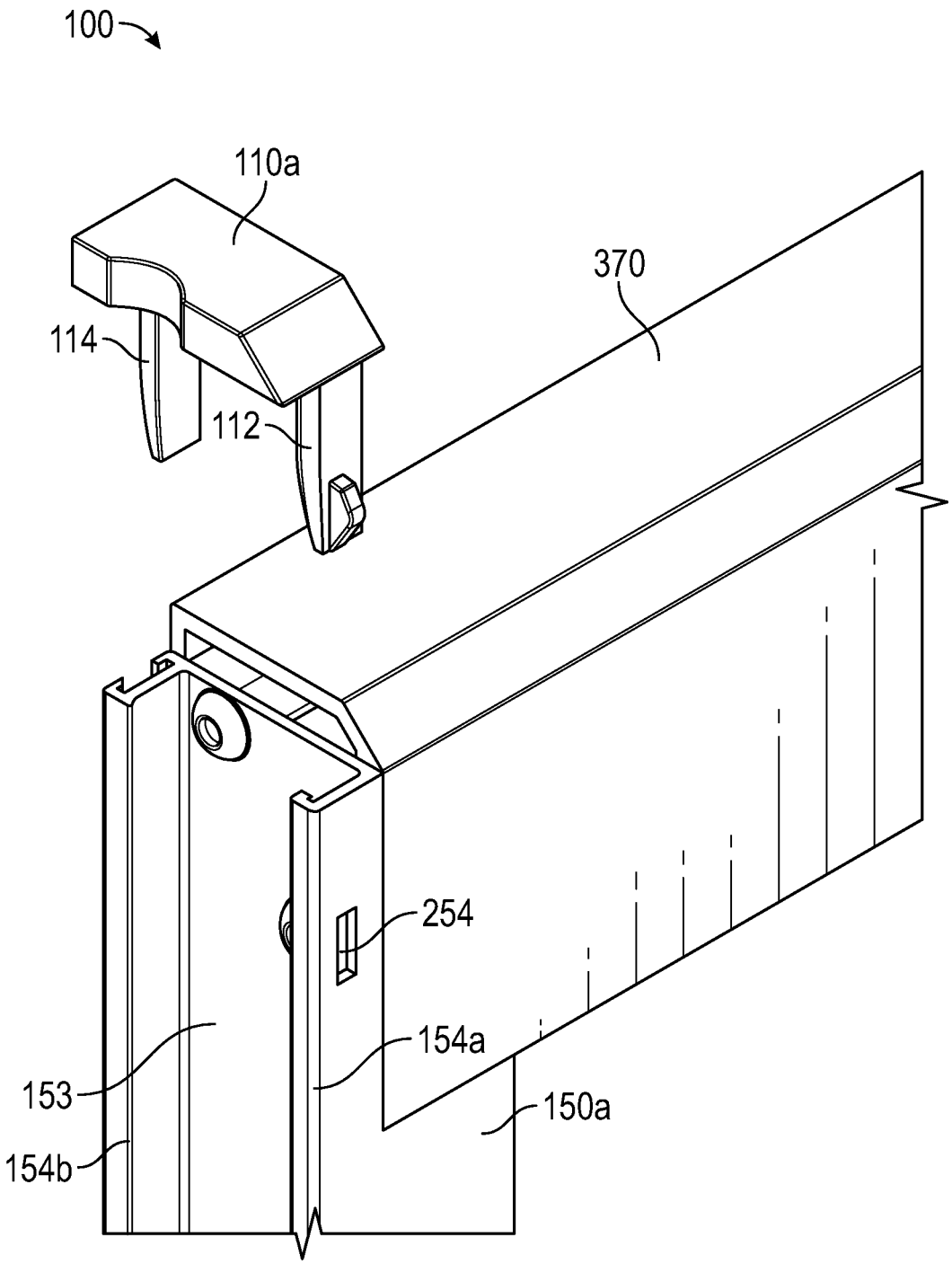
FIG. 5 is a perspective view demonstrating a first step of a method for installing the first sash guide of FIG. 1 on the first stile of FIG. 1.
Figure 6:
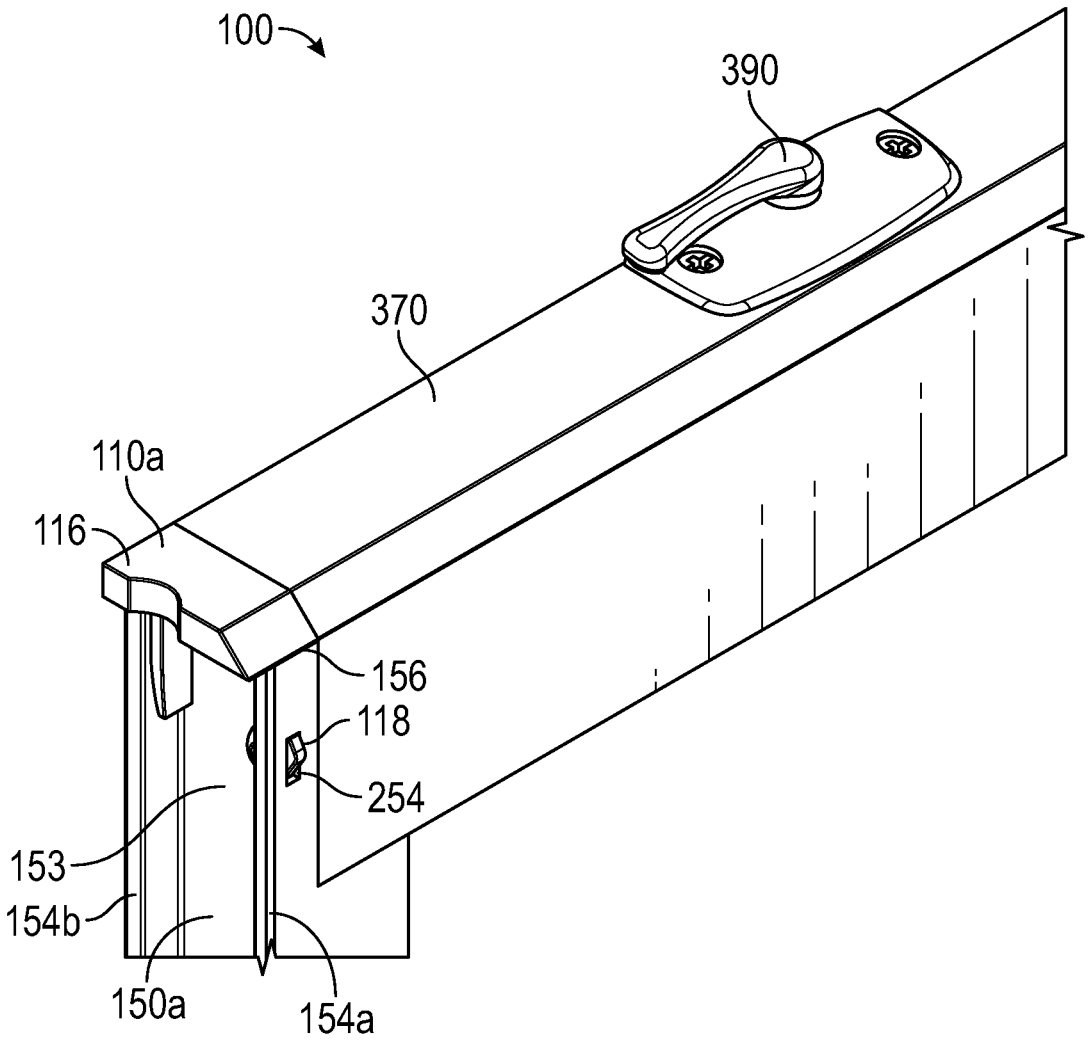
FIG. 6 is a perspective view demonstrating a second step of the method for installing the first sash guide of FIG. 1 on the first stile of FIG. 1.

FIG. 5 and FIG. 6 demonstrate a method for installing the first sash guide 110*a* on the sash 100. As shown in a first step in FIG. 5, the guide legs 112,114 can be aligned with the stile channel 153 with the first guide leg 112 aligned with the first flange 154*a* and the second guide leg 114 aligned with the second flange 154*b*. In a second step shown in FIG. 6, the guide legs 112,114 (shown in FIG. 5) can then be inserted into the stile channel 153 until the locking tab 118 engages the locking slot 254 and the guide cap 116 rests upon the top end 156 of the first stile 150*a*. The locking tab 118 can snap into the locking slot 254 to secure the first sash guide 110*a* to the first stile 150*a*, and the snapping action can provide tactile feedback to an installer to indicate that the first sash guide 110*a* is secured to the first stile 150*a*.

Figure 7:
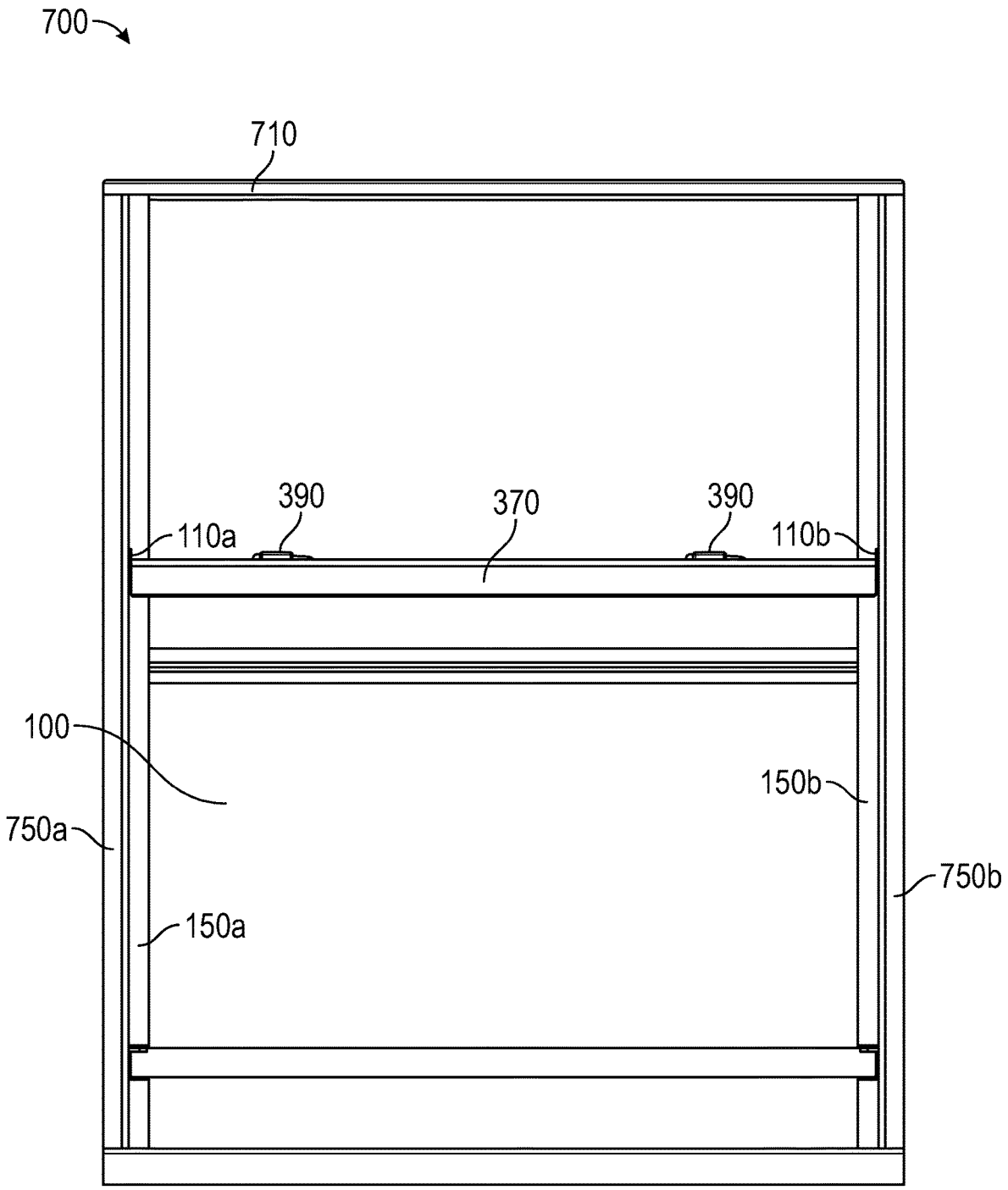
FIG. 7 is a front view of one aspect of a hung window assembly comprising the sash of FIG. 1 and a window frame in accordance with one aspect of the present disclosure.

FIG. 7 is a front view of a hung window assembly 700 comprising the sash 100 and a window frame 710. The window frame 710 comprises a first balance jamb 750*a* and a second balance jamb 750*b*. The sash 100 can be nested between the balance jambs 750*a,b* with the first stile 150*a* positioned adjacent to the first balance jamb 750*a* and a second stile 150*b* of the sash 100 positioned adjacent to the second balance jamb 750*b*. The sash 100 can further comprise the second sash guide 110*b* attached to the second stile 150*b*.

Figure 8:
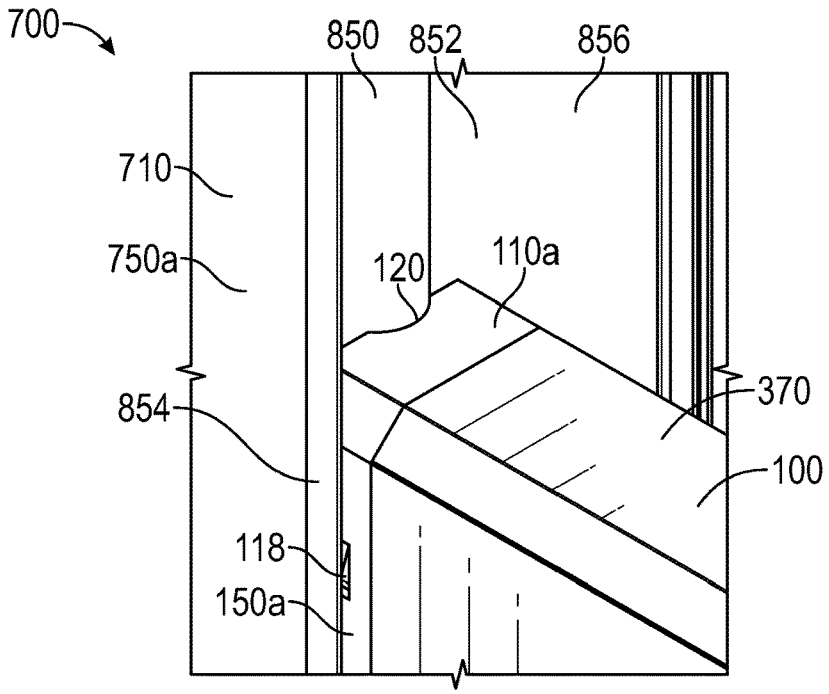
FIG. 8 is a detail perspective view of the hung window assembly of FIG. 7 focused on the first sash guide of FIG. 1.
Figure 9:
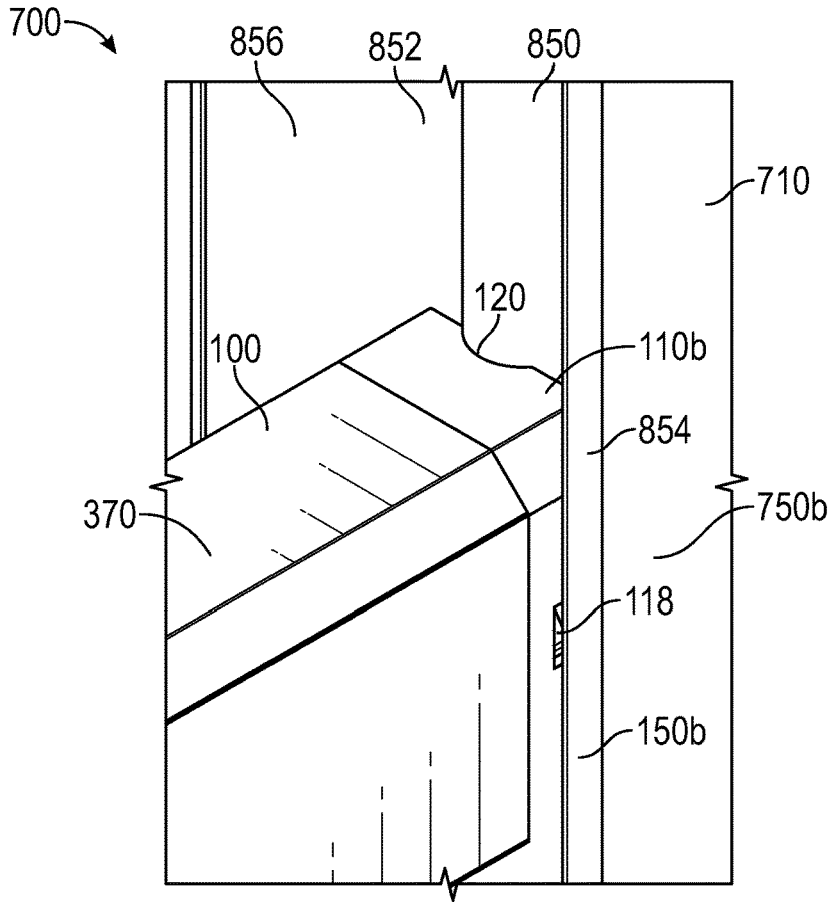
FIG. 9 a detail perspective view of the hung window assembly of FIG. 7 focused on a second sash guide of the sash of FIG. 1.

FIG. 8 is a detail perspective view of the hung window assembly 700 focused on the first sash guide 110*a*, and FIG. 9 is a detail perspective view of the hung window assembly 700 focused on the second sash guide 110*b*. As shown, the first sash guide 110*a* can be a left-hand sash guide, and the second sash guide 110*b* can be a right-hand sash guide. The first stile 150*a* of the sash 100 can ride within a jamb groove 852 defined by the first balance jamb 750*a*, and the second stile 150*b* of the sash 100 can ride within the jamb groove 852 of the second balance jamb 750*b*. Each balance jamb 750*a,b* can respectively define a first flange 854 and a second flange 856, and the jamb groove 852 can be defined between the first flange 854 and the second flange 856 of the respective balance jamb 750*a,b*. Each balance jamb 750*a,b* can comprise a balance 850 disposed within the respective jamb groove 852. The concave balance groove 120 of each respective sash guide 110*a,b* can be shaped and sized complimentary to a profile of the respective balance 850, and the sash guides 110*a,b* can ride along the respective balances 850 to center the sash 100 within the window frame 710.

Additionally, each locking tab 118 can press against the first flange 854 of the respective balance jamb 750*a,b* to bias the sash 100 towards the second flange 856. As shown and described below with respect to FIG. 10, the biasing action of the locking tab 118 pressing against the first flange 854 can enhance a seal formed between the weather strip 190 and the second flange 856 of the first balance jamb 750*a*, as shown by the directional arrows.

Figure 10:
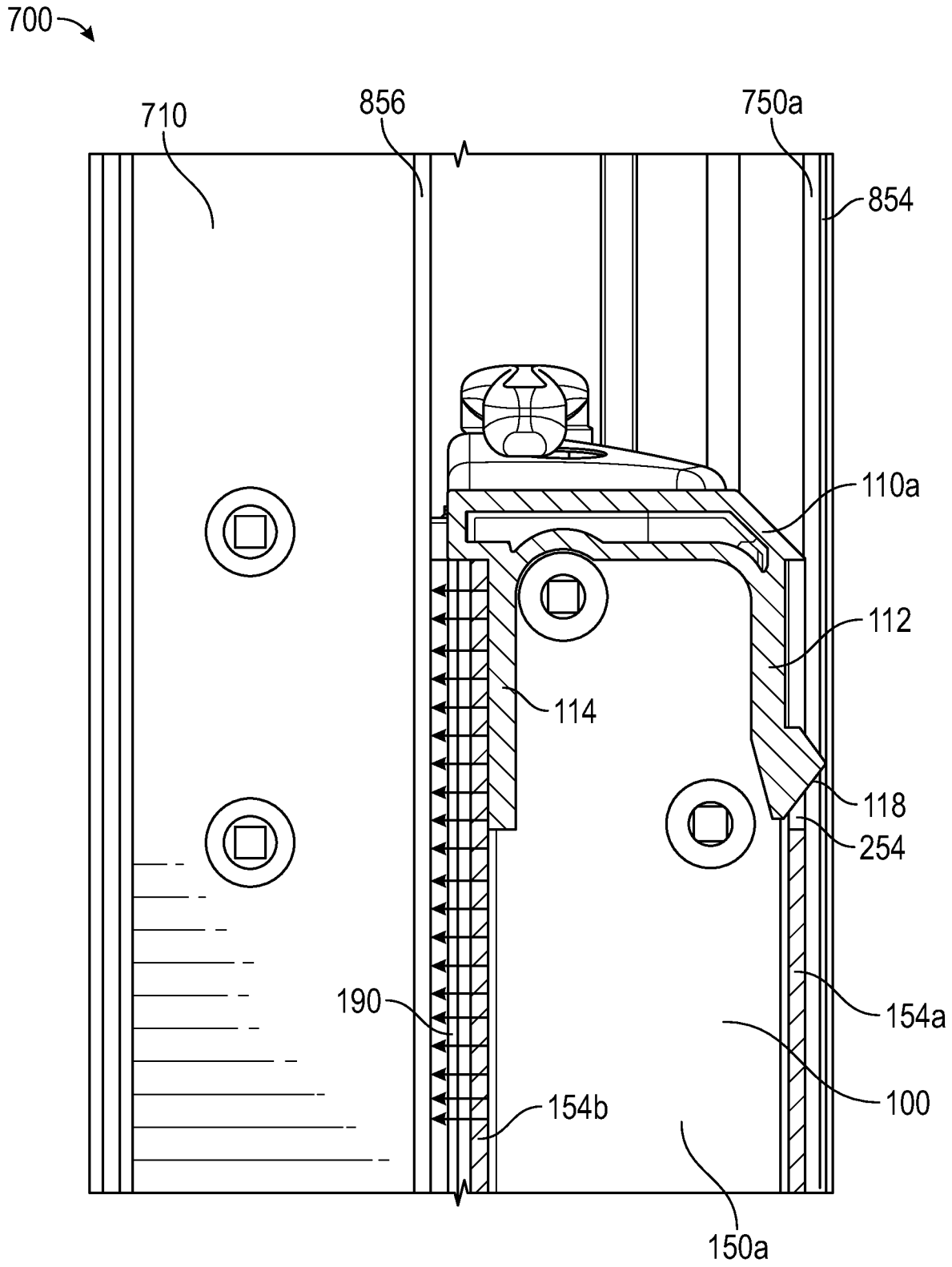
FIG. 10 is a side cross-sectional view of the sash of FIG. 1 positioned between a first flange and a second flange of a first balance jamb of the hung window assembly of FIG. 7.

FIG. 10 is a side cross-sectional view of the first sash guide 110*a* and the first stile 150*a* positioned between the first flange 854 and the second flange 856 of the first balance jamb 750*a*. As shown and previously described, the locking tab 118 can press against the first flange 854 of the first balance jamb 750*a*, thereby biasing the sash 100 towards the second flange 856 of the first balance jamb 750*a*. By biasing the sash 100 towards the second flange 856, the weather strip 190 can positively engage the second flange 856 to improve the quality of the seal between the weather strip 190 and the first balance jamb 750*a*.

An additional benefit of the first sash guide 110*a* is that engagement between the locking tab 118 and the first flange 854 can self-adjust to accommodate variations in the first balance jamb 750*a*. For example, if the first balance jamb 750*a* is pinched and has a narrow spot between the first flange 854 and the second flange 856, the locking tab 118 can be depressed into the locking slot 254 so that the first sash guide 110*a* can adjust and clear the narrow spot without a dimensional gap which might otherwise allow the sash 100 to wobble between the flanges 854,856 of the first balance jamb 750*a*. Due to the resilient nature of the first sash guide 110*a* and the legs 112,114, the first sash guide 110*a* can act as a spring-loaded sash guide, and adjustment of the locking tab 118 can ensure a snug fit of the sash 100 within the window frame 710 while preventing resistance due to dimensional variations when raising and lowering the sash 100.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A sash comprising:

a window frame comprising a balance;

a stile, the stile defining a first flange and a second flange, a locking slot defined extending through the first flange; and a sash guide comprising a concave balance groove shaped to ride along the balance, the sash guide defining a first guide leg and a second guide leg, the first guide leg defining a locking tab, the locking tab extending through the locking slot.

2. The sash of claim 1, wherein:

the stile defines a stile channel between the first flange and the second flange;

the first guide leg and the second guide leg extend into the stile channel;

the first guide leg engages the first flange; and the second guide leg engages the second flange.

3. The sash of claim 2, wherein:

the sash guide defines a guide cap;

the first guide leg and the second guide leg extend downwards from the guide cap; and the guide cap is positioned adjacent to a top end of the stile.

4. The sash of claim 1, wherein:

the sash guide defines a guide cap; and the guide cap defines the concave balance groove.

5. The sash of claim 4, wherein:

the sash is mounted within the window frame; and the concave balance groove aligns with the balance.

6. The sash of claim 1, wherein:

the stile is positioned within a jamb groove of the balance between a first flange of the balance and a second flange of the balance;

the first flange of the stile is positioned adjacent to the first flange of the balance;

the second flange of the stile is positioned adjacent to the second flange of the balance; and the locking tab engages the first flange of the balance and biases the stile towards the second flange of the balance.

7. The sash of claim 6, wherein:

the sash further comprises a weather strip attached to the second flange of the stile; and engagement between the locking tab and the first flange of the balance biases the weather strip to engage the second flange of the balance to form a seal.

8. The sash of claim 1, wherein:

the stile defines a top end;

the sash guide defines a bottom guide cap surface; and the bottom guide cap surface is positioned in facing engagement with the top end of the stile.

9. A sash guide comprising:

a guide cap defining a concave balance groove shaped to ride along a jamb groove of a balance in a window frame, the guide cap defining a bottom guide cap surface;

a first leg extending downwards from the bottom guide cap surface; and a second leg extending downwards from the bottom guide cap surface;

wherein the first leg defines a locking tab extending outwards from the first leg and away from the second leg.

10. The sash guide of claim 9, wherein the locking tab defines a sloped leading edge extending downwards from the locking tab towards an end of the first leg, the end defined opposite from the guide cap.

11. The sash guide of claim 9, wherein the guide cap is a hollow molding.

* * * * *